US007236155B2

(12) United States Patent
Han et al.

(10) Patent No.: US 7,236,155 B2
(45) Date of Patent: Jun. 26, 2007

(54) BACKLIGHT DRIVING CIRCUIT

(75) Inventors: Seung Jun Han, Kyongsangbuk-do (KR); Seong Hyun Yun, Chungju-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 654 days.

(21) Appl. No.: 10/733,205

(22) Filed: Dec. 10, 2003

(65) Prior Publication Data

US 2004/0124790 A1 Jul. 1, 2004

(30) Foreign Application Priority Data

Dec. 24, 2002 (KR) ..... 10-2002-0083401

(51) Int. Cl.
*G09G 3/36* (2006.01)
*G05F 1/00* (2006.01)
*F21V 7/04* (2006.01)

(52) U.S. Cl. ..... 345/102; 345/104; 315/291; 362/630

(58) Field of Classification Search ..... 345/87, 345/102, 104; 362/611, 614, 630, 631; 359/48, 359/50, 54, 57, 58, 60; 315/291
See application file for complete search history.

(56) References Cited

U.S. PATENT DOCUMENTS 6,094,015 A * 7/2000 Wessels et al. ..... 315/291
6,812,916 B2 * 11/2004 Hwang ..... 345/102
7,077,543 B2 * 7/2006 Nishiyama et al. ..... 362/225

FOREIGN PATENT DOCUMENTS

WO WO 01/93644 12/2006

OTHER PUBLICATIONS

Office Action dated Feb. 9, 2007 for corresponding Chinese Patent Application No. 200310113019.9.

* cited by examiner

*Primary Examiner*—Henry N. Tran
(74) *Attorney, Agent, or Firm*—Brinks Hofer Gilson & Lione

(57) ABSTRACT

A backlight of an LCD device includes a protection circuit that permits leakage of a high voltage to a ground terminal. This high voltage is generated by insertion failures of connectors or other failures caused by damage. The backlight driving circuit includes a high-voltage part applying an A.C. high voltage to a first terminal of a plurality of fluorescent lamps, a low-voltage part applying a lower voltage than that of the high-voltage part to a second terminal of the plurality of fluorescent lamps, a connection part that connects the high-voltage part to the low-voltage part and the protection circuit between the low-voltage part and the connection part.

25 Claims, 6 Drawing Sheets

BACKLIGHT DRIVING CIRCUIT

This application claims the benefit of the Korean Application No. P2002-83401 filed on Dec. 24, 2002, which is hereby incorporated by reference.

BACKGROUND OF THE INVENTION

1. Field of the Invention

The present invention relates to a backlight of a liquid crystal display (LCD) device, and more particularly, a backlight driving circuit for preventing damage from a discharge generated by disconnection of a connector between a low-voltage part of a lamp and an inverter.

2. Discussion of the Related Art

With rapid development of information communication fields, the importance displaying desired information has increased dramatically. Recently, cathode ray tubes (CRTs) have been commonly used as display devices in televisions and computer monitors because of their ability to display various colors with high luminance. However, CRTs are relatively large and cannot adequately satisfy present demands for display applications that require reduced weight, portability, low power consumption, and increased screen size and high resolution. Accordingly, flat panel displays have been developed for use as monitors for computers, spacecraft, and aircraft.

Various flat panel displays are in use, for example, a liquid crystal display (LCD) device, an electro-luminescent display (ELD), a field emission display (FED), and a plasma display panel (PDP). At this time, in order to apply the flat panel displays in practical use, it is required to be light and have high luminance, great efficiency, high resolution, rapid response time, low driving voltage, low power consumption, low manufacturing cost and natural color display characteristics. Among the flat panel displays, the LCD device has attracted great attention by having portability and endurance as well as the aforementioned characteristics required for the flat panel displays.

The LCD device is a display device using optical anisotropy of liquid crystal. That is, when light is irradiated on the liquid crystal having polarizing characteristics according to a voltage apply state, light transmittance is controlled by an alignment state of the liquid crystal, thereby displaying a picture image. However, the LCD device requires an additional light source since the LCD device in and of itself does not emit light. One such LCD device is a reflective type LCD device. A reflective type LCD device uses ambient light but has limitations due to the environmental problems. As a result, a transmitting type LCD device having an additional light source such as a backlight has been developed. For instance, light sources such as electro-luminescence (EL), a light-emitting diode (LED), a cold cathode fluorescent lamp (CCFL) and a hot cathode fluorescent lamp (HCFL) are used for the backlight of the transmitting type LCD device. Of these, the cold cathode fluorescent lamp (CCFL) is most widely used for the backlight as the CCFL is thin and has low power consumption.

FIG. 1 is a perspective view schematically illustrating a transmitting type TN mode LCD device according to the related art. As shown in FIG. 1, the transmitting type TN mode LCD device an LCD panel having an upper substrate 11, a lower substrate 12, and a liquid crystal layer 13. At this time, the upper substrate 11 is formed of a color filter array for displaying colors, and the lower substrate 12 is formed of a thin film transistor array for selectively applying driving signals to respective pixels. Then, the liquid crystal layer 13 is formed between the upper and lower substrates 11 and 12. In addition, first and second polarizing plates 14 and 15 are formed on upper and lower surfaces of the LCD panel 10, in which polarizers of the first and second polarizing plates 14 and 15 are positioned in perpendicular to each other. Although not shown, a backlight is formed below the LCD panel 10 for irradiating light of a fluorescent lamp to the LCD panel. The backlight includes a light-guiding plate, a reflecting plate, a diffusion plate and a prism sheet.

At this time, the lower substrate 12 of the thin film transistor array includes a plurality of gate and data lines crossing each other to define a plurality of pixel regions, a plurality of pixel electrodes respectively formed in the pixel regions, and a plurality of thin film transistors at crossing points of the gate and data lines for being switched by signals of the gate lines. Also, the upper substrate 11 of the color filter array includes a black matrix layer for excluding light from portions except the pixel regions, a color filter layer for displaying R/G/B color at portions to be corresponding to the pixel electrodes, and a common electrode between the black matrix layer and the color filter layer. In this state, the pixel electrode (not shown) of the lower substrate 12 and the common electrode (not shown) of the upper substrate 11 are formed of transparent conductive metals such as Indium-Tin-Oxide ITO for transmitting the light emitted from the backlight. In case of an IPS (in-plane switching) mode LCD device, the common electrode is formed on the lower substrate.

Then, alignment layers (not shown) are formed on opposing surfaces of the upper and lower substrates 11 and 12 for aligning liquid crystal molecules 18 of the liquid crystal layer 13, whereby the liquid crystal molecules are aligned and twisted at 90° between the lower substrate 12 and the upper substrate 11. Also, the first and second polarizing plates 14 and 15 have perpendicular polarizing directions. That is, the white light emitted from the backlight is polarized to one direction according to the first polarizing plate 14, and then the polarizing light is refracted in the lower substrate 12 and the liquid crystal layer 13. At this time, as shown in the drawings, the light incident on the liquid crystal layer 13 is refracted to be in perpendicular with the direction polarized by the first polarizing plate 14 according to the liquid crystal molecules 18 rotated at 90°. Thus, it is possible to control light transmittance according to the alignment direction of the liquid crystal molecules 18 of the liquid crystal layer 13.

Next, the white light refracted by the liquid crystal layer 13 is transmitted to the upper substrate 11 having the color filter (not shown) for displaying R/G/B color, and then transmitted to the second polarizing plate 15, thereby displaying a picture image. Thus, in the general LCD device, the light transmittance is controlled by polarizing and refracting the light irradiated from the backlight, thereby displaying the picture image.

The backlight is classified into a direct type and an edge type according to the location of the fluorescent lamp. In the edge type backlight, a cylindrical fluorescent lamp is formed at one side of the LCD panel, and a transparent light-guiding plate is formed to transmit the light emitted from the fluorescent lamp to an entire surface of the LCD panel. The edge type backlight has the problem of low luminance. Also, optical design and processing technology for the light-guiding plate are required to obtain uniform luminance.

Meanwhile, the direct type backlight is suitable for a large sized LCD device of 20 inches or more, in which a plurality of fluorescent lamps are arranged in one direction below a light-diffusion plate to directly illuminate an entire surface of the LCD panel with light. That is, a direct type backlight unit having great light efficiency is commonly used for the large sized LCD device requiring high luminance. However, the direct type is problematic in that a silhouette of the fluorescent lamp may be reflected on the LCD panel. Thus, a predetermined interval has to be maintained between the fluorescent lamp and the LCD panel, so that it is hard to obtain a thin profile in the LCD device having the direct type backlight unit. As the panel becomes large, the size of the light-emitting surface of the backlight is increased. With a large-sized direct type backlight, an appropriate thickness of a light-scattering means is required. If the thickness of the light-scattering means is not appropriately thin, the light-emitting surface is not flat.

Despite this, the direct type backlight is used in a LCD device requiring high luminance and an edge type backlight unit is generally used in relatively small sized LCD devices such as monitors of laptop computers and desktop computers. With the trend towards increasingly large-sized LCD panels, the direct type backlight is actively developed by forming the plurality of fluorescent lamps under a screen, or by disposing one bent fluorescent lamp, thereby obtaining a backlight of high luminance.

FIG. 2 is a perspective view illustrating a general direct type backlight, and FIG. 3 schematically illustrates a fluorescent lamp. As shown in FIG. 2, the direct type backlight according to the related art includes a plurality of fluorescent lamps 1, an outer case 3, and a light-scattering means 5. The plurality of fluorescent lamps 1 are arranged at fixed intervals in one direction, and the outer case 3 fixes the plurality of fluorescent lamps for maintaining the fixed intervals. The light-scattering means 5 is provided above the fluorescent lamps 1. The light-scattering means 5 prevents the silhouette of the fluorescent lamps 1 from being reflected on the display surface of the LCD panel (not shown), and provides a light source with uniform luminance. For improving the light-scattering effect, the light-scattering means 5 is comprised of a plurality of diffusion sheets and one diffusion plate 5*a*, 5*b* and 5*c*. Also, a reflecting plate 7 is provided inside the outer case 3 for concentrating the light emitted from the fluorescent lamps 1 to the display part of the LCD panel, thereby improving light efficiency. Also, referring to FIG. 3, the fluorescent lamps 1 are respectively fixed to both sides of the outer case 3. Each fluorescent lamp 1 is a cold cathode fluorescent lamp 1, which is charged with discharge gas. Each fluorescent lamp 1 includes electrodes 2*a* and 2*b* for receiving external power (not shown), and wires 9*a* and 9*b* connected to the electrodes 2*a* and 2*b*. The wires 9*a* and 9*b* are connected to a driving circuit by an additional inverter (not shown). Thus, each fluorescent lamp 1 requires an additional inverter.

FIG. 4 is a circuit diagram schematically illustrating an inverter circuit of a backlight according to the related art. The inverter circuit according to the related art includes a DC-AC converter 31, and a plurality of output connectors 32*a* and 32*b*. At this time, the DC-AC converter 31 converts an inverter driving voltage Vcc1 to an A.C. high voltage for driving the fluorescent lamp, and then outputs the A.C. high voltage. A current flows from the plurality of output connectors 32*a* and 32*b* to both ends of the fluorescent lamp 1. The fluorescent lamp 1 is connected to the A.C. high voltage output from the DC-AC converter 31 in series.

Herein, the DC-AC converter 31 includes switching devices Q1 and Q2, and a high voltage Transformer T1. The switching devices Q1 and Q1 output a driving voltage Vcc1 to the high voltage Transformer T1 by alternately switching the driving voltage Vcc1. The high voltage Transformer 1 includes a primary coil and a secondary coil, in which the primary coil receives the driving voltage Vcc1 from the switching devices Q1 and Q2, and the secondary coil outputs a high voltage according to a winding ratio of the primary and secondary coils. Also, L1 is a line filter, R1–R3 are resistors, C1–C3 are condensers, and D1 is a diode.

Driving of the inverter circuit of the backlight according to the related art will be described as follows. For driving the inverter circuit according to the related art, the inverter driving voltage Vcc1 is input to the DC-AC converter 31 through the line filter L1, and the plurality of switching devices Q1 and Q2 of the DC-AC converter 31 alternately switches the inverter driving voltage Vcc1 by push-pull operation, thereby outputting the inverter driving voltage Vcc1 applied to a collector to the primary side of the Transformer T1. Then, the Transformer T1 outputs the voltage induced to the primary side n1 to the secondary side n2 according to the winding ratio of n1 to n2, and outputs the A.C. high voltage to the high voltage output connector 32*a*.

The A.C. high voltage output from the DC-AC converter 31 is applied to a fluorescent lamp 1 through the high voltage output connector 32*a* and the low voltage output connector 32*b*. At this time, a voltage corresponding to a current flowing in the fluorescent lamp 1 and resistance value R3 is generated in the low voltage output connector 32*b*. Meanwhile, the backlight according to the related art includes the plurality of inverter circuits for driving the plurality of fluorescent lamps 1, and the plurality of inverter circuits are positioned at the rear of the backlight.

FIG. 5 is a circuit diagram illustrating a driving circuit provided at the rear of a backlight according to the related art. FIG. 6 is a detail view illustrating a low-voltage part of FIG. 5. As shown in FIG. 5, the backlight according to the related art further includes a high-voltage part 21, a low-voltage part 23, and a connection part 25. At this time, the high-voltage part 21 is formed at one portion of a rear side of an LCD panel 10 (not shown) to have an inverter circuit 20 (circuit of FIG. 4) converting a D.C. voltage to an A.C. voltage for driving a fluorescent lamp (1 of FIG. 2), and the low-voltage part 23 is formed at the other portion of the rear side of the LCD panel 10 to have a lower electric potential as compared to that of the high-voltage part 21. The connection part 25 is formed to connect the low-voltage part 23 to a feedback terminal (not shown) of the inverter circuit 20 of the high-voltage 21. Herein, the fluorescent lamps 1 are formed in parallel to the LCD panel 10, and power supplying lines (9*a* and 9*b* of FIG. 3) are connected to both sides of the each fluorescent lamp 1 by the high voltage output connector 32*a* of the high-voltage part 21 and the low voltage output connector 32*b* of the low-voltage part 22.

Also, the connection part 25 includes insulating wirings corresponding to the number of fluorescent lamps (1 of FIG. 2). Also, the connection part 25 includes first and second feedback connectors 22*a* and 22*b* for electrically connecting the high-voltage part 21 to the low-voltage part 23. The connection part 25 may have a signal wiring, or a plurality of wirings corresponding to the number of fluorescent lamps according to a control method of the fluorescent lamps 1. The current of the fluorescent lamps 1 is controlled according to the voltage or the current of the low-voltage part input by feedback of the inverter circuit 20. If single wiring is used, problems may occur due to different characteristics of the respective fluorescent lamps. If the plurality of wirings are used, it is possible to control the fluorescent lamps in due consideration of the impedance of the respective fluorescent lamps 1. As a result, deflection of the current is decreased among the plurality of fluorescent lamps 1, thereby providing uniform luminance by decreasing the difference of luminance among the plurality of fluorescent lamps 1.

In the backlight according to the related art, in order to connect the high-voltage part 21 to the low-voltage part 23 by using a plurality of wirings, the first and second feedback connectors 22*a* and 22*b* are connected to the respective wirings. That is, it is possible to decrease the distance between pins of the first and second feedback connectors 22*a* and 22*b*. Referring to FIG. 6, the low-voltage part of the backlight according to the related art includes a plurality of connectors 24 connected to the power supplying line 9*a* or 9*b* of each fluorescent lamp, and a second feedback connector 22*b* for collecting the plurality of power source lines 26 connected to the respective connectors 24, on a PCB (printed circuit board). Each connector 24 may be connected to the power supplying lines of two fluorescent lamps.

However, the backlight according to the related art has the following disadvantages.

In the backlight according to the related art, if insertion failures of the pins of the first and second feedback connectors or other failures caused by damage exist, a discharge is generated due to a voltage difference among the plurality of pins, so that the feedback connectors are burned. Thus, connectors having pins at wider intervals than the discharge distance must be used, which generates mechanical limitations on the size of the connectors.

SUMMARY OF THE INVENTION

Accordingly, the present invention is directed to a backlight driving circuit that substantially obviates one or more problems due to limitations and disadvantages of the related art.

An advantage of the present invention is protection of a connection part and a high-voltage part in a backlight including a ground circuit for grounding a high voltage between the connection part and a low-voltage part.

Additional advantages and features of the invention will be set forth in part in the description which follows and in part will become apparent to those having ordinary skill in the art upon examination of the following or may be learned from practice of the invention. The advantages of the invention may be realized and attained by the structure particularly pointed out in the written description and claims hereof as well as the appended drawings.

To achieve these and other advantages and in accordance with the invention, as embodied and broadly described herein, a backlight driving circuit includes a high-voltage part configured to apply an A.C. high voltage to a first terminal of a plurality of fluorescent lamps; a low-voltage part configured to apply a lower voltage than that of the high-voltage part to a second terminal of the plurality of fluorescent lamps; a connection part that connects the high-voltage part to the low-voltage part; and a protection circuit between the low-voltage part and the connection part.

The connection part may include first and second feedback connectors that electrically connect the high-voltage part to the low-voltage part.

The protection circuit may include a plurality of zener diodes and a resistance. In this case, the plurality of zener diodes may be respectively connected to a power source and a ground terminal at different directions, and the resistance connected between the zener diodes.

The plurality of zener diodes and the resistance may be formed on a PCB (Printed Circuit Board) of the low-voltage part.

Pins of the first and second feedback connectors may be disposed at intervals smaller than that of a discharge distance that would permit a discharge to occur at the high and low voltages applied by the high-voltage part and low-voltage part, respectively, if insertion failures of the first and second feedback connectors existed and the protection circuit were removed.

In another aspect, a backlight driving circuit includes a high-voltage part at a first portion of a rear side of an LCD panel, configured to apply an A.C. high voltage to a first terminal of a plurality of fluorescent lamps; a low-voltage part at a second portion of the rear side of the LCD panel, configured to apply a lower electric potential than that of the high-voltage part to a second terminal of the plurality of fluorescent lamps; a connection part that connects the high-voltage part to the low-voltage part; and a protection circuit through which a high voltage, generated between the low-voltage part and the connection part, is shunted to a ground terminal.

The connection part may include first and second feedback connectors that electrically connect the high-voltage part to the low-voltage part.

The protection circuit may include a plurality of zener diodes and a resistance. In this case, the plurality of zener diodes may be respectively connected to a power source and a ground terminal at different directions, and the resistance connected between the zener diodes. The plurality of zener diodes and the resistance may be formed on a PCB (Printed Circuit Board) of the low-voltage part.

Pins of the first and second feedback connectors may be disposed at intervals smaller than that of a discharge distance that would permit a discharge to occur at the high and low voltages applied by the high-voltage part and low-voltage part, respectively, if insertion failures of the first and second feedback connectors existed and the protection circuit were removed.

The arrangement may further comprise a direct type backlight that includes the high-voltage part, the low-voltage part, the connection part, and the protection circuit. An LCD device may comprise the backlight driving circuit.

In another aspect, a method of protecting a backlight driving circuit of an LCD comprises obtaining a high-voltage part and a low-voltage part that respectively supply an A.C. high voltage and a voltage lower than that of the A.C. high voltage to a plurality of fluorescent lamps; obtaining a connection part that connects the high-voltage part and the low-voltage part; and obtaining a protection circuit between the low-voltage part and the connection part.

The connection part may include first and second feedback connectors that electrically connect the high-voltage part to the low-voltage part.

The protection circuit may include a plurality of zener diodes and a resistance. In this case, the plurality of zener diodes may be respectively connected to a power source and a ground terminal at different directions, and the resistance connected between the zener diodes. The plurality of zener diodes and the resistance may be formed on a PCB (Printed Circuit Board) of the low-voltage part.

The method may further comprise grounding the low-voltage part when a voltage generated between the high-voltage part and the low-voltage part is large enough to permit a discharge to occur if insertion failures of the first and second feedback connectors existed and the protection circuit were removed. In this case, pins of the first and second feedback connectors may be disposed at intervals smaller than that of a discharge distance over which discharge between the pins would occur.

The method may further comprise applying light generated by the plurality of fluorescent lamps to a display panel of the LCD, obtaining a direct type backlight that includes the high-voltage part, the low-voltage part, the connection part, and the protection circuit, testing the protection circuit before incorporating the backlight driving circuit in the LCD device, and/or manufacturing the backlight driving circuit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to embodiments of the present invention, examples of which are illustrated in the accompanying drawings. Wherever possible, the same reference numbers will be used throughout the drawings to refer to the same or like parts.

A backlight according to the present invention will be described with reference to the accompanying drawings.

Figure 1:
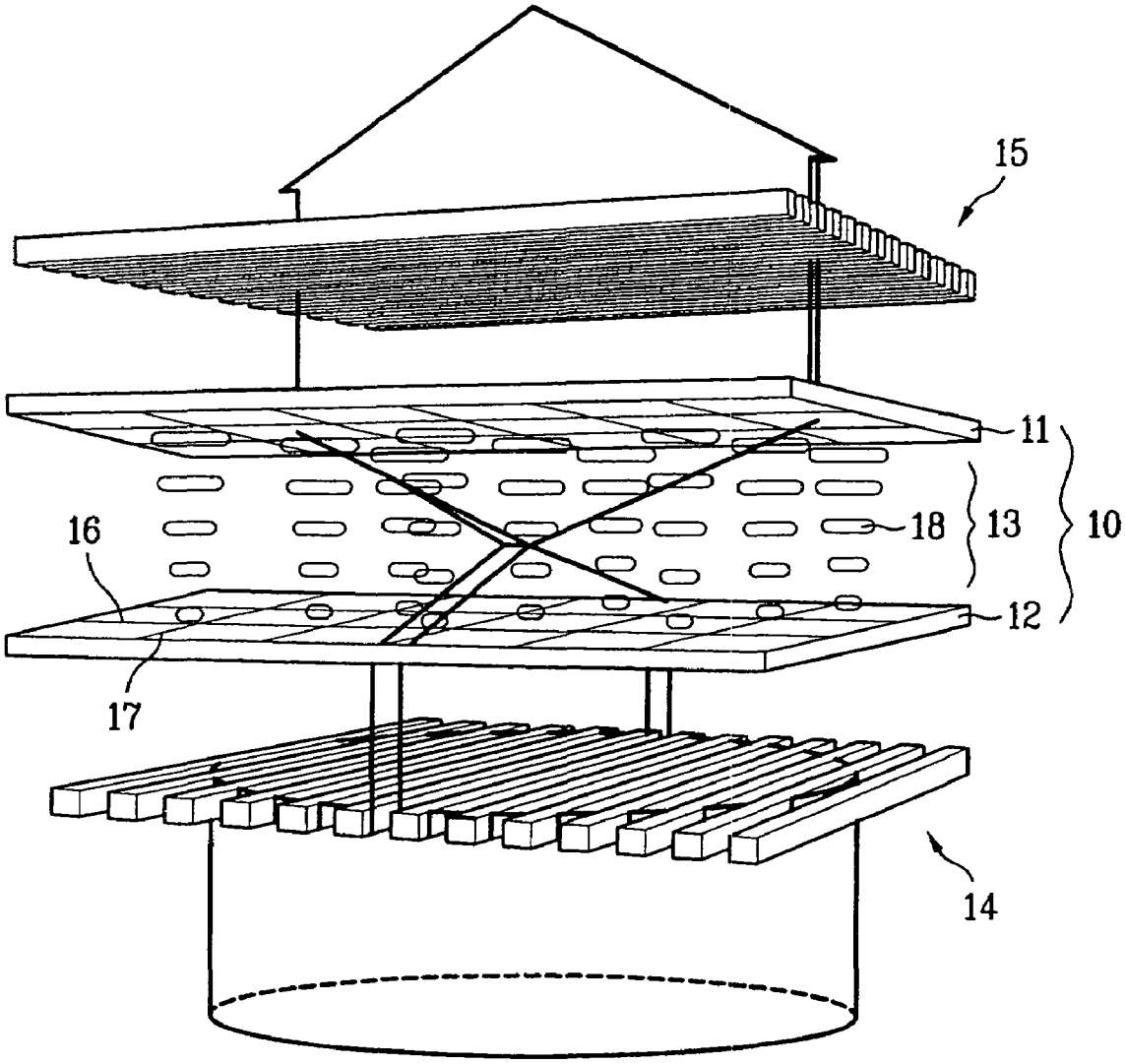
FIG. 1 Related Art
FIG. 1 is a perspective view illustrating a general LCD device.
Figure 2:
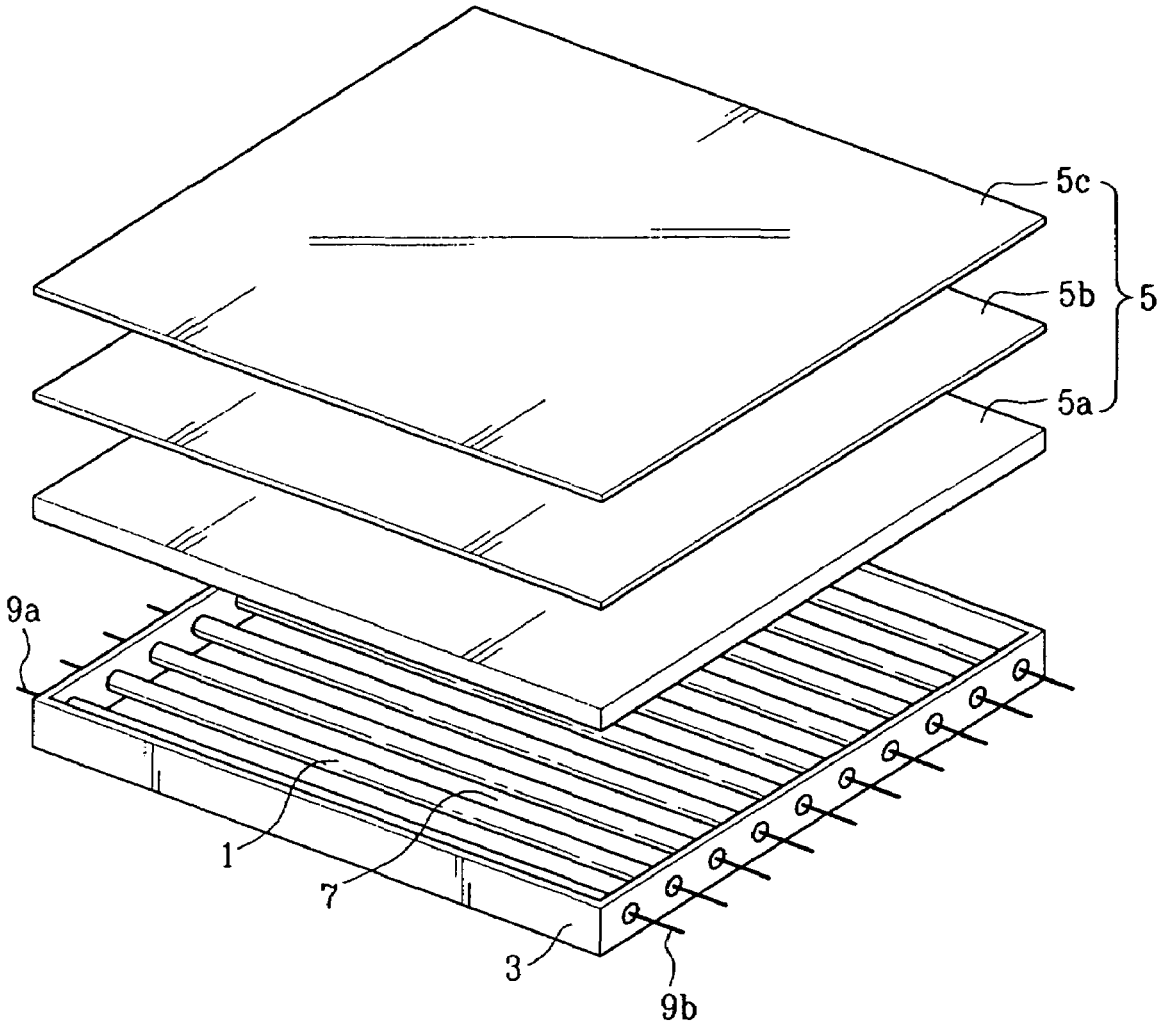
FIG. 2 Related Art
FIG. 2 is a perspective view illustrating a general direct-type backlight.
Figure 3:
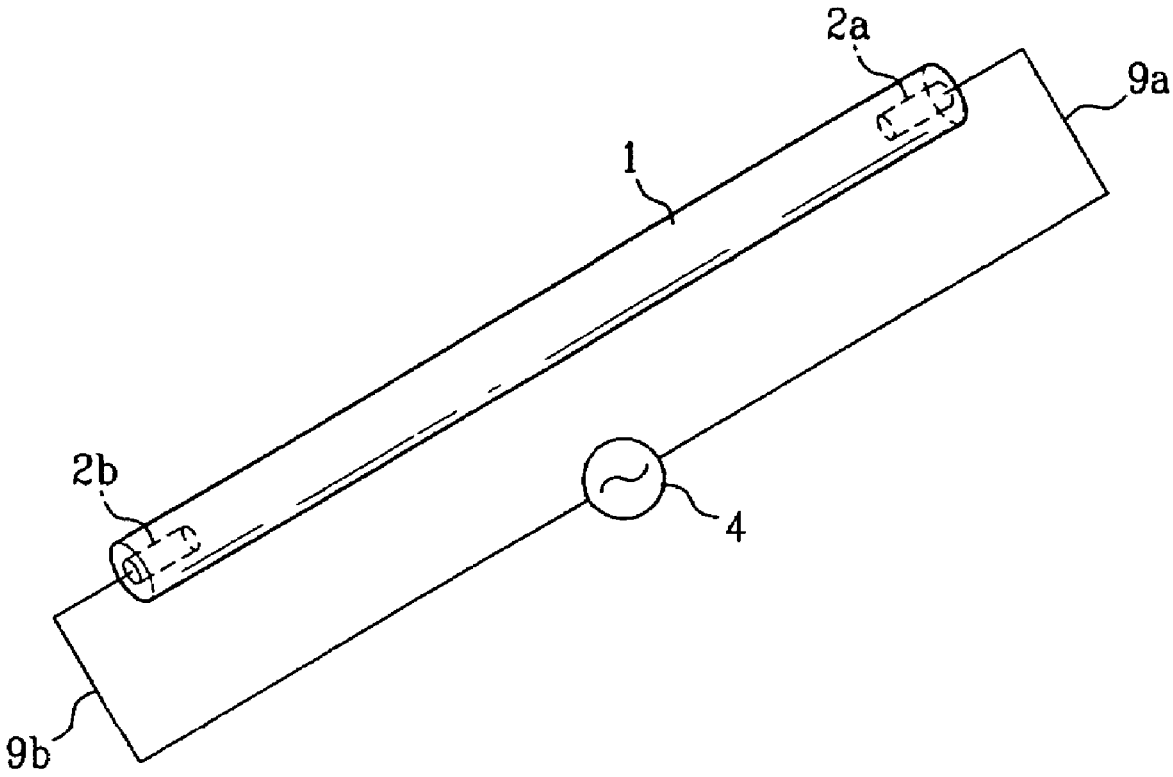
FIG. 3 Related Art
FIG. 3 schematically illustrates a general fluorescent lamp.
Figure 4:
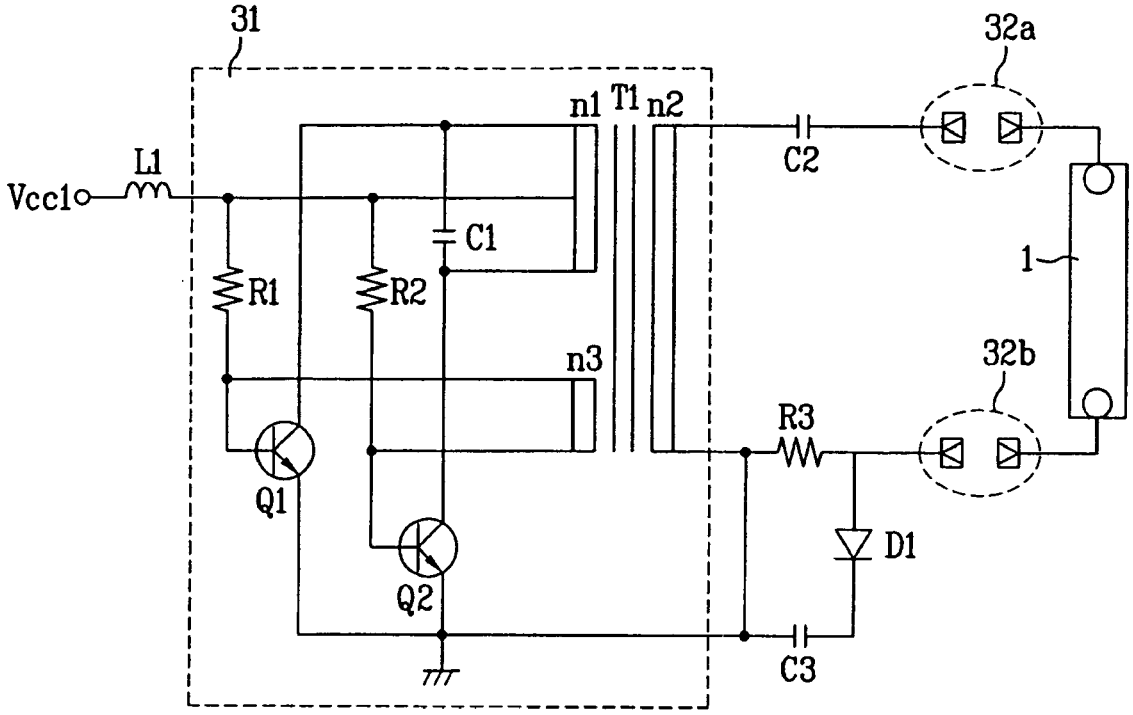
FIG. 4 Related Art
FIG. 4 is a circuit diagram schematically illustrating an inverter circuit of a backlight according to the related art.
Figure 5:
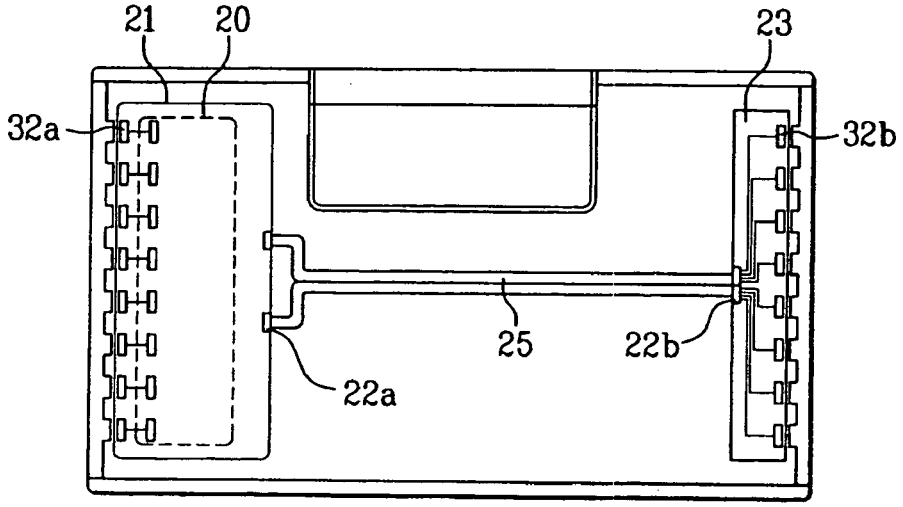
FIG. 5 Related Art
FIG. 5 is a circuit diagram illustrating a driving circuit provided at the rear of a backlight according to the related art.
Figure 6:
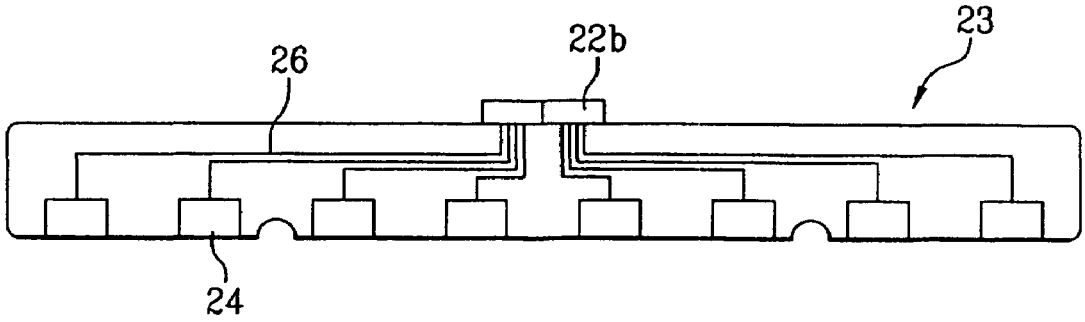
FIG. 6 Related Art
FIG. 6 is a detail view illustrating a low-voltage part of FIG. 5.
Figure 7:
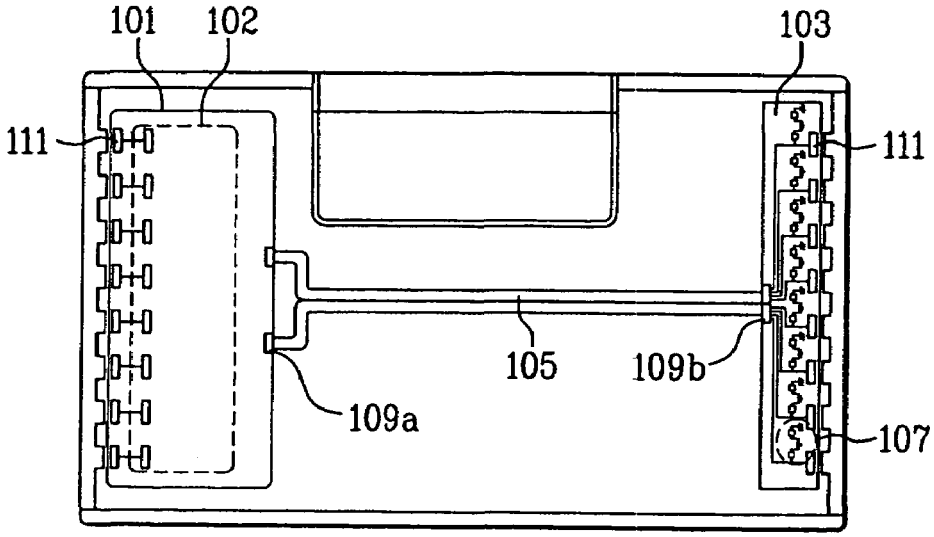
FIG. 7 is a circuit diagram illustrating a driving circuit provided at the rear of a backlight according to the present invention.
Figure 8:
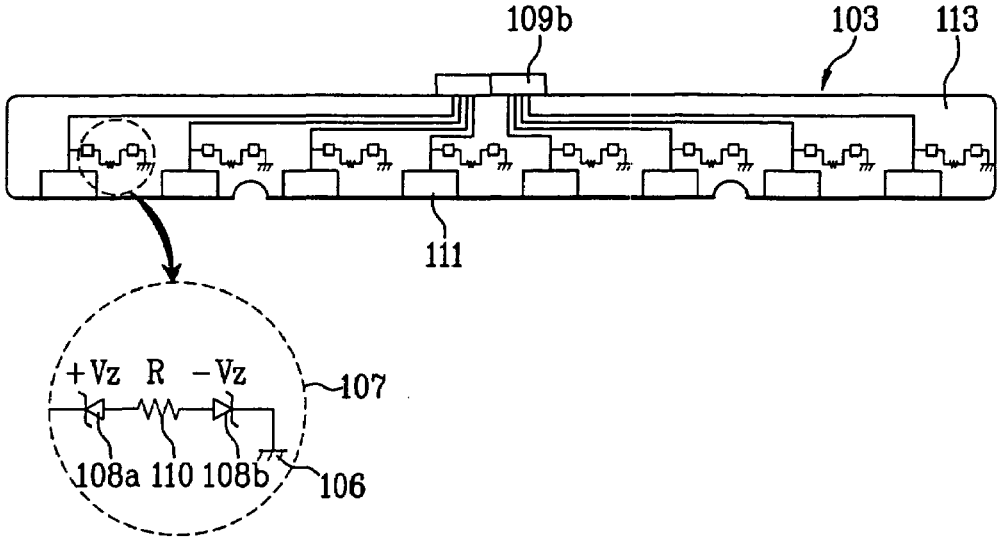
FIG. 8 is a detailed view illustrating a low-voltage part of FIG. 7.

FIG. 7 is a circuit diagram illustrating a driving circuit provided at the rear of a backlight according to the present invention, and FIG. 8 is a detailed view illustrating a low-voltage part of FIG. 7.

As shown in FIG. 7 and FIG. 8, the backlight according to the present invention includes a high-voltage part 101, a low-voltage part 103, a connection part 105, and a protection circuit 107. At this time, the high-voltage part 101 is formed at one portion of a rear side of an LCD panel (not shown) for generating an A.C. high voltage from a D.C. power source using an inverter circuit. Also, the low-voltage part 103 is formed at the other portion of the rear side of the LCD panel to have a lower electric potential than that of the high-voltage part 101. The connection part 105 connects the low-voltage part 103 to a feedback circuit of the inverter circuit 102 of the high-voltage part 101, and the protection circuit 107 is formed inside the low-voltage part 103 for grounding a high voltage generated between the low-voltage part 103 and the connection part 105.

Although not shown, the connection part 105 includes insulating wirings corresponding to the number of fluorescent lamps (not shown). Also, the connection part 105 includes first and second feedback connectors 109*a* and 109*b* that electrically connect the high-voltage part 101 to the low-voltage part 103. The protection circuit 107 contains first and second zener diodes 108*a* and 108*b*, and a resistor 110. When a high voltage is generated by insertion failures of the first and second feedback connectors 109*a* and 109*b* or other failures caused by damage, the protection circuit 107 shunts the high voltage to a ground terminal. A high voltage is a voltage that is large enough to generate a discharge between pins of the connector due to a voltage difference among the plurality of pins or to damage the inverter circuit or the first and second feedback connectors. The first and second zener diodes 108*a* and 108*b* are connected in different directions. Connection of the zener diodes 108*a* and 108*b* in different directions permits excessive voltages of both polarities to be drained to ground. A first high voltage is applied to the power supplying line at one side of the fluorescent lamp (not shown) in a direct-type backlight, a second high voltage having a phase oppose to that of the first high voltage may be generated in a power supplying line at the other side of the fluorescent lamp.

Figure 9:
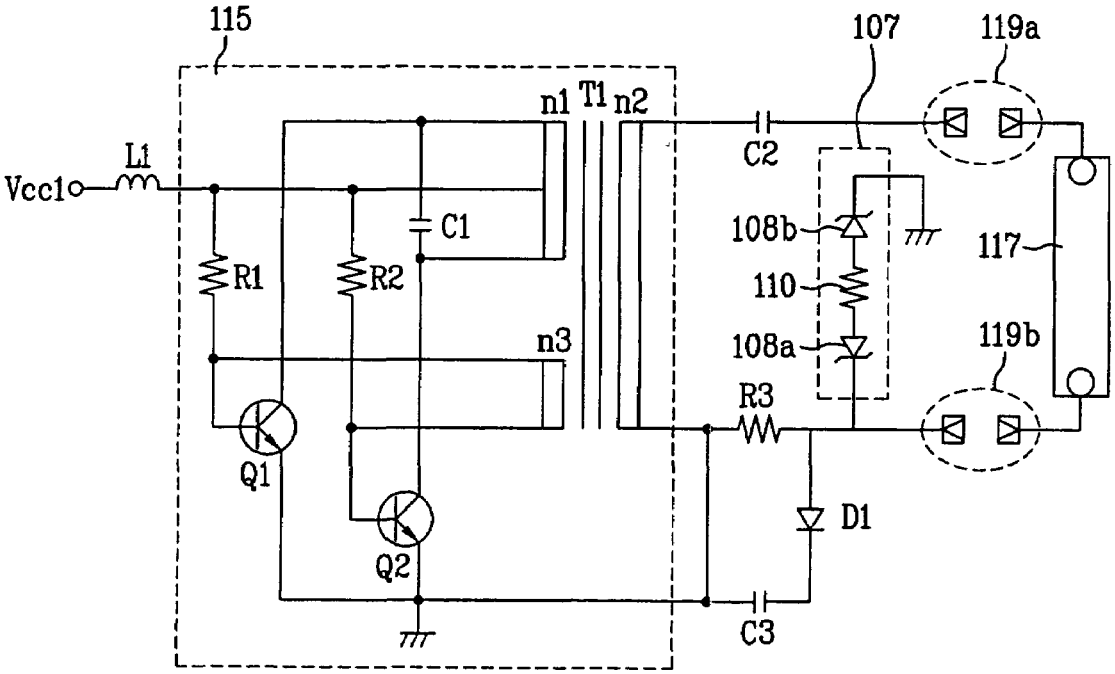
FIG. 9 is a circuit diagram schematically illustrating an inverter circuit of a backlight according to the present invention.

As shown in FIG. 9, which schematically illustrates a circuit diagram of an inverter circuit of a backlight according to the present invention, the inverter circuit includes a DC-AC converter 115 and a plurality of output connectors 119*a* and 119*b*. The DC-AC converter 115 converts an inverter driving voltage Vcc1 to an A.C. high voltage for driving the fluorescent lamp and then outputs the A.C. high voltage. A currently flows from the plurality of output connectors 119*a* and 119*b* to both ends of each fluorescent lamp 117. The fluorescent lamp 117 is connected in series to the A.C. high voltage output from the DC-AC converter 115.

Herein, the DC-AC converter 115 includes switching devices Q1 and Q2, and a high voltage Transformer T1. The switching devices Q1 and Q2 output a driving voltage Vcc1 to the high voltage Transformer T1 by alternately switching the driving voltage Vcc1. The high voltage Transformer T1 includes a primary coil and a secondary coil, in which the primary coil receives the driving voltage Vcc1 from the switching devices Q1 and Q2, and the secondary coil output a high voltage according to a winding ratio of the primary and secondary coils. Also, L1 is a line filter, R1–R3 are resistors, C1–C3 are condensers, and D1 is a diode.

Driving of the inverter circuit will be described as follows.

For driving the inverter circuit, the inverter driving voltage Vcc1 is input to the DC-AC converter 115 through the line filter L1 and the plurality of switching devices Q1 and Q2 of the DC-AC converter 115 alternately switches the inverter driving voltage Vcc1 by push-pull operation, thereby outputting the inverter driving voltage Vcc1 to a primary side of the Transformer T1. Then, the Transformer T1 outputs the voltage induced in the primary side n1 to the secondary side n2 dependent on the winding ratio of n1 to n2 and outputs the A.C. high voltage to the high voltage output connector 119*a*.

The A.C. high voltage output from the DC-AC converter 115 is applied to the fluorescent lamp 117 through the high voltage output connector 119*a* and the low voltage output connector 119*b*. At this time, a voltage corresponding to the current flowing in the fluorescent lamp 117 and resistance value R3 is generated in the low voltage output connector 119*b*.

Accordingly, in the backlight according to the present invention, if insertion failures of the first and second feedback connectors 109*a* and 109*b* connected to the low voltage output connector 119*b* or other failures caused by damage exist, a high voltage may be generated between the inverter circuit of the high-voltage part 101 and the low-voltage part 103. In this case, the high voltage generated between the high-voltage part 101 and the low-voltage part 103 is grounded through the protection circuit 107 formed in the low-voltage part 103, thereby protecting the first and second feedback connectors 109*a* and 109*b*. That is, the backlight according to the present invention includes the protection circuit 107 that grounds the low-voltage part 103 if a high voltage is generated between the inverter circuit of the high-voltage part 101 and the low-voltage part 103, thereby preventing electric discharge from being generated between pins of the first and second feedback connectors 109*a* and 109*b*.

Also, even if a high voltage is generated, it is possible to leak out the high voltage through the protection circuit 107, thereby protecting the inverter circuit (102 of FIG. 7). Furthermore, it is possible to prevent electrical discharge due to a voltage difference between the pins of the first and second feedback connectors 109*a* and 109*b*. This permits the interval of the pins in the respective first and second feedback connectors 109*a* and 109*b* to be decreased. That is the interval of the pins in the respective first and second feedback connectors 109*a* and 109*b* are not required to be wide, thereby removing the above mentioned mechanical limitations.

A structure of the backlight according to the present invention will be described as follows. First, the backlight according to the present invention sequentially includes a first connector 111, the high-voltage part 101, the connection part 105, the low-voltage part 103, and a second connector 111. More specifically, the first connector 111 is formed in a power supplying line at one side of the fluorescent lamp (not shown) and the high-voltage part 101 includes the inverter circuit 102. Also, the connection part 105 includes the first feedback connector 109*a* connected to the high-voltage part 101 and the second feedback connector 109*b* connected to the other side of the first feedback connector 109*a*. The low-voltage part 103 is connected to the high-voltage part 101 using the connection part and includes the protection circuit 107 that prevents a high voltage generated by insertion failures of the first and second feedback connectors 109*a* and 109*b* or other failures caused by damage. Furthermore, the second connector 111 is formed in a power supplying line at the other side of the fluorescent lamp.

It is also possible to provide another feedback connector between the connection part 105 and the low-voltage part 103. Also, the high-voltage part 101 and the low-voltage part 103 may be mounted on a PCB substrate 113 and components of the inverter circuit 102 and the protection circuit 107 formed thereon. Accordingly, the protection circuit 107 is provided by connecting the first and second zener diodes 108*a* and 108*b*, respectively connected to the power source and the ground terminal 106 in different directions on the PCB substrate 113 of the low-voltage part 103, to the resistor 110 between the first and second zener diodes 108*a* and 108*b*. Such an arrangement permits protection of the first and second feedback connectors 109*a* and 109*b* and the inverter circuit 102 from a high voltage generated between the connection part 105 and the low-voltage part 103.

As mentioned above, the backlight according to the present invention has the following advantages.

In the backlight according to the present invention, the protection circuit permits leakage of a high voltage generated by the insertion failures of the connectors or other failures caused by damage to the ground terminal. As a result, it is possible to protect the connectors and the fluorescent lamp from the high voltage, thereby improving endurance of the backlight.

It will be apparent to those skilled in the art that various modifications and variations can be made in the present invention. For example, although zener diodes and a resistor are used to drain excessive voltages, other circuitry may be used to shunt the high voltage to ground may be used. Thus, it is intended that the present invention covers the modifications and variations of this invention provided they come within the scope of the appended claims and their equivalents.

What is claimed is:

1. A backlight driving circuit comprising:

a high-voltage part configured to apply an A.C. high voltage to a first terminal of a plurality of fluorescent lamps;

a low-voltage part configured to apply a lower voltage than that of the high-voltage part to a second terminal of the plurality of fluorescent lamps;

a connection part that connects the high-voltage pad to the low-voltage pad; and a protection circuit between the low-voltage part and the connection part.

2. The backlight driving circuit of claim 1, wherein the connection part includes first and second feedback connectors that electrically connect the high-voltage part to the low-voltage part.

3. The backlight driving circuit of claim 2, wherein pins of the first and second feedback connectors are disposed at intervals smaller than that of a discharge distance that would permit a discharge to occur at the high and low voltages applied by the high-voltage part and low-voltage part, respectively, if insertion failures of the first and second feedback connectors existed and the protection circuit were removed.

4. The backlight driving circuit of claim 1, wherein the protection circuit includes a plurality of zener diodes and a resistor.

5. The backlight driving circuit of claim 4, wherein the plurality of zener diodes and the resistance are formed on a PCB (Printed Circuit Board) of the low-voltage part.

6. The backlight driving circuit of claim 4, wherein the plurality of zener diodes are respectively connected to a power source line, between the low-voltage part and the connection part and a ground terminal in different directions and the resistor is connected between the zener diodes.

7. A backlight driving circuit comprising:

a high-voltage part at a first portion of a rear side of an LCD panel, the first high-voltage part configured to apply an AC. high voltage to a first terminal of a plurality of fluorescent lamps;

a low-voltage part at a second portion of the rear side of the LCD panel, the low-voltage part configured to apply a lower electric potential than that of the high-voltage part to a second terminal of the plurality of fluorescent lamps;

a connection part that connects the high-voltage part to the low-voltage part; and a protection circuit through which a high voltage generated between the low-voltage part and the connection part is shunted to a ground terminal.

8. The backlight driving circuit of claim 7, wherein the connection part includes first and second feedback connectors that electrically connect the high-voltage part to the low-voltage part.

9. The backlight driving circuit of claim 8, wherein pins of the first and second feedback connectors are disposed at intervals smaller than that of a discharge distance that would permit a discharge to occur at the voltages applied by the high-voltage part and low-voltage part, respectively, if insertion failures of the first and second feedback connectors existed and the protection circuit were removed.

10. The backlight driving circuit of claim 7, wherein the protection circuit includes a plurality of zener diodes and a resistor.

11. The backlight driving circuit of claim 10, wherein the plurality of zener diodes and the resistor are formed on a PCB (Printed Circuit Board) of the low-voltage part.

12. The backlight driving circuit of claim 10, wherein the zener diodes are respectively connected to a power source line, between the low-voltage part and the connection part, and the ground terminal in different directions and the resistor is connected between the zener diodes.

13. The backlight driving circuit of claim 7, further comprising a direct type backlight that includes the high-voltage part, the low-voltage part, the connection part, and the protection circuit.

14. An LCD device comprising the backlight driving circuit of claim 7.

15. A method of protecting a backlight driving circuit of an LCD device, the method comprising:

obtaining a high-voltage part and a low-voltage part that respectively supply an A.C. high voltage and a voltage lower than that of the A.C. high voltage to a plurality of fluorescent lamps;

obtaining a connection part that connects the high-voltage part and the low-voltage part; and obtaining a protection circuit between the low-voltage part and the connection part.

16. The method of claim 15, wherein the connection part includes first and second feedback connectors that electrically connect the high-voltage part to the low-voltage part.

17. The method of claim 16, further comprising grounding the low-voltage part when a voltage generated between the high-voltage part and the low-voltage part is large enough to permit a discharge to occur if insertion failures of the first and second feedback connectors existed and the protection circuit were removed.

18. The method of claim 17, wherein pins of the first and second feedback connectors are disposed at intervals smaller than that of a discharge distance over which discharge between the pins would occur.

19. The method of claim 15, wherein the protection circuit includes a plurality of zener diodes and a resistor.

20. The method of claim 19, wherein the plurality of zener diodes are respectively connected to a power source line, between the low-voltage part and the connection part, and a ground terminal in different directions and the resistor is connected between the zener diodes.

21. The method of claim 20, wherein the plurality of zener diodes and the resistance are formed on a PCB (Printed Circuit Board) of the low-voltage part.

22. The method of claim 15, further comprising applying light generated by the plurality of fluorescent lamps to a display panel of the LCD.

23. The method of claim 15, further comprising obtaining a direct type backlight that includes the high-voltage part, the low-voltage part, the connection part, and the protection circuit.

24. The method of claim 15, further comprising testing the protection circuit before incorporating the backlight driving circuit in the LCD device.

25. The method of claim 15, further comprising manufacturing the backlight driving circuit.

* * * * *